US005636604A

United States Patent [19]

Speil

[11] Patent Number: 5,636,604

[45] Date of Patent: Jun. 10, 1997

[54] TAPPET FOR A VALVE DRIVE OF AN INTERNAL COMBUSTION ENGINE

[75] Inventor: Walter Speil, Ingolstadt, Germany

[73] Assignee: Ina Walzlager Schaeffler KG, Germany

[21] Appl. No.: 619,578

[22] PCT Filed: Nov. 4, 1994

[86] PCT No.: PCT/EP94/03630

§ 371 Date: Mar. 19, 1996

§ 102(e) Date: Mar. 19, 1996

[87] PCT Pub. No.: WO95/13457

PCT Pub. Date: May 18, 1995

[30] Foreign Application Priority Data

Nov. 12, 1993 [DE] Germany ..... 9317325 U

[51] Int. Cl.[6] ..... F01L 1/25

[52] U.S. Cl. ..... 123/90.55; 123/90.51

[58] Field of Search ..... 123/90.48, 90.49, 123/90.51, 90.52, 90.55; 74/569

[56] References Cited

U.S. PATENT DOCUMENTS 5,239,953 8/1993 Shida ..... 123/90.55

FOREIGN PATENT DOCUMENTS 0140674 5/1985 European Pat. Off. .
3023686 1/1982 Germany .
23008 2/1984 Japan ..... 123/90.55
93/19286 9/1993 WIPO .

OTHER PUBLICATIONS

Copy of Hydraulic Valve . . . Engine Abstract, vol. 10, No. 14, (M-447) (2071) Sep. 1985 (1 pg.) Patent Abstract of Japan.

*Primary Examiner*—Weilun Lo
*Attorney, Agent, or Firm*—Bierman, Muserlian and Lucas

[57] ABSTRACT

A tappet (1) for a valve drive or an internal combustion engine comprising a hollow cylindrical housing (2) guided for axial displacement by a jacket (3) thereof in a reception bore (4) of a cylinder head (5), an end of the housing (2) facing a cam (8) being closed by a bottom (7), a guide sleeve (11) arranged concentrically in the tappet (1) for guiding a hydraulic clearance compensation element (10) being supported by a connected web (12) against the jacket (3) which is made of two separate, bush-like sections (14,15) of approximately equal diameter separated from each other in the region of a central transverse plane, and a first cup-shaped section (14) of the jacket (3) being connected at a cam-proximate end thereof to the bottom (7), characterized in that the second, lower section (15) comprises an extension (16) starting axially adjacent the first section (14) and extending into an immediate vicinity of the bottom (7), the second section (15) with its extension (16) has a smaller wall thickness than the first section (14) and is made as a sheet metal or plastic element, the extension (16) bears by an outer peripheral surface (17) thereof against an inner peripheral surface (18) of the first section (14).

17 Claims, 1 Drawing Sheet

TAPPET FOR A VALVE DRIVE OF AN INTERNAL COMBUSTION ENGINE

Figure 1:
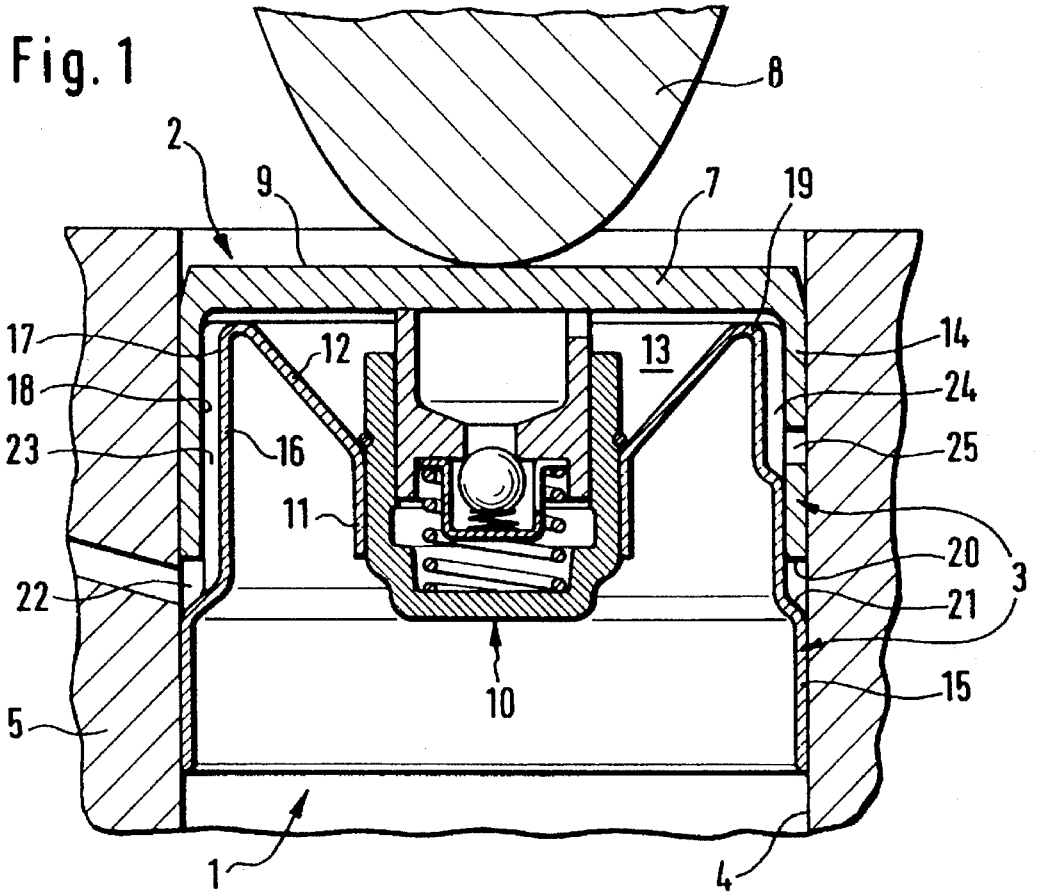

The invention concerns a tappet for a valve drive of an internal combustion engine comprising a hollow cylindrical housing guided for axial displacement by a jacket thereof in a reception bore of a cylinder head, an end of the housing facing a cam being closed by a bottom, a guide sleeve arranged concentrically in the tappet for guiding a hydraulic clearance compensation element being supported by a connected web against the jacket which is made of two separate, bush-like sections of approximately equal diameter separated from each other preferably in the region of a central transverse plane, and a first cup-shaped section of the jacket being connected at a cam-proximate end thereof to the bottom.

A tappet of this type is described in EP-A-04 85 007 and likewise comprises a tappet jacket divided along a central transverse plane and having an upper section closed by a bottom. A web comprising a guide portion for receiving a hydraulic clearance compensation element extends radially inwards from the lower section. An oil channel leads through a plastic cushion arranged in the annular oil reservoir into the central oil reservoir for supplying hydraulic medium to the clearance compensation element. A drawback of the tappet known from EP-A-04 85 007, which is considered as the generic prior art, is that the bottom together with the two separate jacket sections and the web is a relatively solid structure. Moreover, the plastic cushion arranged in the annular oil reservoir also has a detrimental effect on the total mass and thus also on the oscillating mass of the valve drive. Due to the fact of direct suction into the reservoir which is situated at a higher lever, there exists the inherent danger of air and oil foam being sucked into the high pressure chamber during the base circle phase of the tappet. This is particularly unfavorable when the internal combustion engine is operated only for short periods, for example in the so-called "taxi" or "stop-and-go" mode and results in an undesired yielding of the valve drive during the high-pressure phase of the tappet, i.e. during valve lift. In addition, the oil transfer bead arranged in the bottom detracts from the rigidity of the bottom which as a result has to be made with a larger thickness.

A further prior art document, EP-A-04 43 146, discloses a tappet whose jacket is made integrally with the bottom and the jacket itself is also a one-piece structure. Within the tappet, there is arranged coaxial with the jacket surface, a thin-walled guide element comprising an ascending groove for hydraulic oil. This prior art document too, does not disclose any means for reducing the mass of the tappet because its jacket has a relatively solid configuration and is made integrally with the bottom. Moreover, the aforesaid guide element also increases the total mass.

It is therefore an object of the invention to provide a tappet of the precited type in which the discussed drawbacks are eliminated and which, particularly, is simple to manufacture and possesses a high strength.

The invention achieves this object by the fact that the second, lower section comprises an extension starting axially adjacent the first section and extending into the immediate vicinity of the bottom, the second section with its extension has a smaller wall thickness than the first section and is made as a sheet metal or plastic element, the extension bears by an outer peripheral surface thereof against an inner peripheral surface of the first section, the web extends from a bottom-proximate edge of the extension in cam-remote direction to support the guide sleeve, an annular groove is formed in the second section between a cam-remote edge of the first section and a facing edge of the second section oriented towards the cam, and at least one channel extends from the annular groove to feed oil into the tappet interior, said channel extending axially between the outer peripheral surface of the extension and the inner peripheral surface of the first section.

The two-piece configuration of the tappet described herein constitutes a major step in obtaining a light-weight structure. The lower section of the jacket not only fulfils a guiding function but also the function of oil path reversal of the hitherto separately made guide sleeve. The lower section is thinner and therefore also simpler to manufacture so that assembly and manufacturing costs are reduced as compared to conventional tappets. The light-weight tappet of the invention permits a reduction of the valve spring forces as well as a reduction of the thickness of the bottom with its cam-contacting surface. The optimum dimensions of the light-weight valve drive are determined empirically and lead to a minimization of the driving energy required for operating the valve drive. The aforesaid annular groove in the lower section makes it possible to avoid additional machining and do without further components for assuring a reliable oil supply to the clearance compensation element.

The one-piece configuration of the web with the guide sleeve and the extension results in an embodiment which is particularly favorable from the manufacturing point of view. Preferably, all the elements of this one-piece component are thin-walled and made by chipless shaping, and the tappet may also be used as a light-weight mechanical tappet in which case, however, the guide sleeve and the web can be dispensed with. The invention covers not only the funnel-shaped arrangement described herein but also other configurations such as, for example, a radially extending web with orthogonal extensions.

Another feature of the invention concerns a simple measure for removing air possibly contained in an oil reservoir of the tappet. Between the extension of the second section and the inner peripheral surface of the first section, there is formed at least one further, axially extending channel into which at least one deaeration bore through the first section opens, the channel being configured separately from the annular groove.

In a further embodiment of the invention, the first and the second sections are connected to each other by a joining of their constitutive materials by welded, soldered or glued joints which can be advantageously arranged at different locations. It is also conceivable to use shape-locked or force-locked connections such as snap or clamp joints, interlocking and the like.

Other measures concern additional measures for weight optimization and wear reduction in the present tappet. For example, it would be conceivable to make the upper section out of an engineering ceramic or to use aluminium as the base material for at least one of the two sections and to reinforce only highly loaded parts.

The disc-shaped wear-resistant element can be configured, for example, as a hardened steel plate but may optionally also be made of a ceramic material.

Particularly with a view to a contact of the outer wall of the tappet with an aluminium bore of a cylinder head, the cup-shaped section may be made of brass or coated with brass because this has a very conducive effect on the wear behavior of such a contact.

The aforesaid disc-shaped wear-resistant element can be arranged, for example, in a separate lodging in the bottom but may also be made to cover the entire width of the bottom.

The feature wherein both sections (14 and 15) are made of a steel which is weldable in a hardened state excludes distortion which can occur due to the heat treatment which normally follows welding.

Finally, to obtain a further reduction of weight, the lower section or the extension may comprise window-like apertures.

The invention is not limited to the features described in the claims. Conceivable is also a combination of individual features of the claims with one another and with the disclosures contained in the discussion of advantages and the examples of embodiment.

Figure 2:
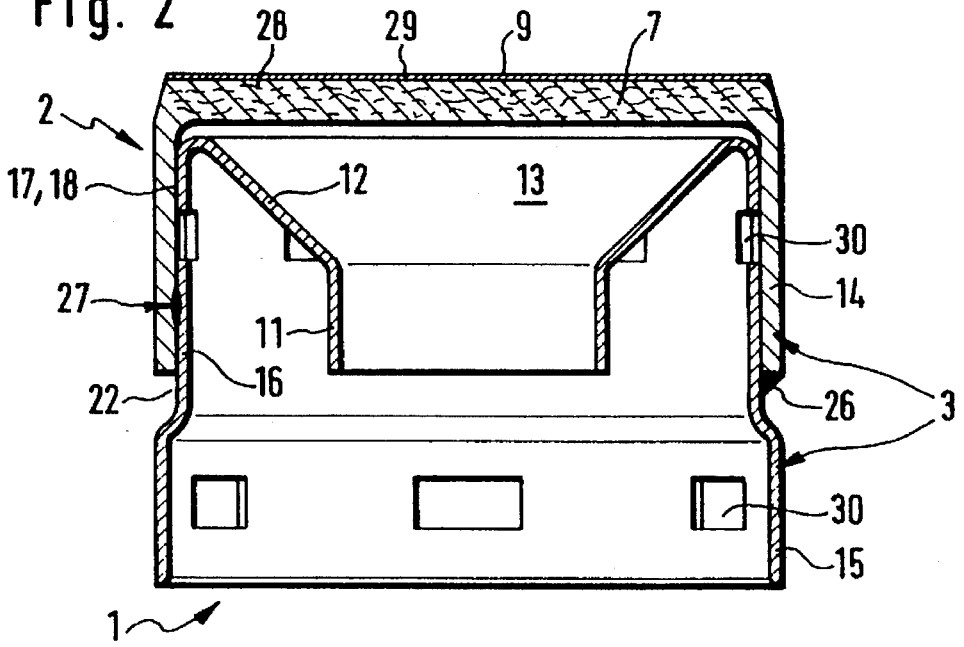

The invention is represented in the drawings in which:

FIG. 1 shows a transverse cross-section through a tappet of the invention, and FIG. 2 shows a modified cross-section according to FIG. 1.

FIG. 1 shows a tappet 1 of the invention which comprises a hollow cylindrical housing 2 guided by its jacket 3 for axial displacement in a reception bore 4 of a cylinder head 5. One end of the tappet 1 is closed by a circular bottom 7 whose end face 9 directed towards a cam 8 is contacted by said cam. A hydraulic clearance compensation element 10 is arranged coaxial with the jacket 3 within a guide sleeve 11 in the tappet interior. The guide sleeve 11 is made integrally with a funnel-shaped web 12 which, in a cam-remote direction, defines a concentric oil reservoir 13 from which hydraulic medium is supplied to the clearance compensation element 10. The jacket 3 of the housing 2 is divided along a central transverse plane into two parts and thus comprises a first and a second section 14, 15. At its end facing the cam, the first section 14 is closed by the bottom 7. The second section 15 is arranged axially adjacent to the first section 14 in cam-remote direction and comprises a hollow cylindrical extension 16 extending in cam direction. An outer peripheral surface 17 of the extension 16 bears at least portion wise against an inner peripheral surface 18 of the first section 14. Starting from an upper edge 19 of the extension 16, the web 12 is formed integrally therewith and merges into the guide sleeve 11. An annular groove 22 for oil supply to the clearance compensation element 10 is formed between mutually facing edges, 20 and 21, of the first and second sections 14 and 15 respectively. Between the extension 16 and the first section 14, there extends an axially parallel channel 23 leading from the annular groove 22 to the oil reservoir 13.

As can be seen in the right half of the figure, a further channel 24 can be defined by the extension 16. One end of this channel 24 communicates with the oil reservoir 13 while its other end opens into a deaeration bore 25 made in the first section 14. In the cam-remote direction, this channel 24 is separated from the annular groove 22.

Different methods of joining the two sections 14, 15 of the housing 2 are shown in FIG. 2. For this purpose, a welded joint 26, but also a soldered or glued joint 27 between the extension 16 and the first section 14, may be used.

The bottom 7 can be made of a polymeric material or reinforced with embedded fibers or particles 28. For the purpose of wear protection, it is also possible to apply a wear-resistant coating layer 29, for example, of a ceramic or other suitable material.

I claim:

1. A tappet (1) for a valve drive of an internal combustion engine comprising a hollow cylindrical housing (2) guided for axial displacement by a jacket (3) thereof in a reception bore (4) of a cylinder head (5), an end of the housing (2) facing a cam (8) being closed by a bottom (7), a guide sleeve (11) arranged concentrically in the tappet (1) for guiding a hydraulic clearance compensation element (10) being supported by a connected web (12) against the jacket (3) which is made of two separate, bush-like sections (14, 15) of approximately equal diameter separated from each other in the region of a central transverse plane, and a first cup-shaped section (14) of the jacket (3) being connected at a cam-proximate end thereof to the bottom (7), characterized in that the second, lower section (15) comprises an extension (16) starting axially adjacent the first section (14) and extending into an immediate vicinity of the bottom (7), the second section (15) with its extension (16) has a smaller wall thickness than the first section (14) and is made as a member of the group consisting of a sheet metal and plastic element, the extension (16) bears by an outer peripheral surface (17) thereof against an inner peripheral surface (18) of the first section (14), the web (12) extends from a bottom-proximate edge (19) of the extension (16) in a cam-remote direction to support the guide sleeve (11), an annular groove (22) is formed in the second section (15) between a cam-remote edge (20) of the first section (14) and a facing edge (21) of the second section (15) oriented towards the cam, and at least one channel (23) extends from the annular groove (22) to feed oil into the tappet interior, said channel (23) extending axially between the outer peripheral surface (17) of the extension (16) and the inner peripheral surface (18) of the first section (14).

2. A tappet of claim 1 wherein the web (12) is made in one piece with the guide sleeve (11) and the extension (16) and extends substantially funnel-shaped in said cam-remote direction.

3. A tappet of claim 1 wherein at least one further, axially extending channel (24) is arranged between the extension (16) of the second section (15) and the inner peripheral surface (18) of the first section (14), at least one deaeration bore (25) passing through the first section (14) opens into said further channel (24), and said further channel (24) is separated from the annular groove (22).

4. A tappet of claim 1 wherein the first section (14) is connected to the second section (15) by a joining of materials.

5. A tappet of claim 4 wherein the joining of materials is obtained by a welded, soldered or glued joint (26, 27).

6. A tappet of claim 4 wherein the joint is arranged along an annular groove (22) which extends between said cam-remote edge (20) of the first section (14) and said facing edge (21) of the second section (15) oriented towards the cam.

7. A tappet of claim 4 wherein the joint is arranged in an annular region between the outer peripheral surface (17) of the extension (16) and the inner peripheral surface (18) of the first section (14).

8. A tappet of claim 1 wherein at least one member of the group consisting of at least one of the two sections (14, 15) and the bottom (7) is made of a light-weight material.

9. A tappet of claim 1 wherein the cup-shaped section (14) of the housing (2) is made of aluminium.

10. A tappet of claim 1 wherein at least one member of the group consisting of the lower section (15) and the extension (16) comprises window-like apertures (30).

11. A tappet of claim 1 wherein at least one of the two sections (14, 15) is made of a ceramic material.

12. A tappet of claim 1 wherein both sections (14 and 15) are made of a steel which is weldable in a hardened state.

13. A tappet of claim 1 wherein at least one member of the group consisting of at least one of the two sections (14, 15) and the bottom (7) is made of a polymeric material and is reinforced with fibers, particles or lattices (28) embedded therein.

14. A tappet of claim 1 wherein at least one member of the group consisting of the jacket (3) of the housing (2) and a cam-proximate end face (9) of the bottom (7) comprises a wear-resistant coating layer (29).

15. A tappet of claim 8 wherein at least one of the two sections (14, 15) is made of a ceramic material.

16. A tappet of claim 6 wherein the joint is arranged along an annular groove (22) which extends between said cam-remote edge (20) of the first section (14) and said facing edge (21) of the second section (15) oriented towards the cam.

17. A tappet of claim 6 wherein the joint is arranged in an annular region between the outer peripheral surface (17) of the extension (16) and the inner peripheral surface (18) of the first section (14).

* * * * *